US006620003B2

(12) United States Patent
Mardikian

(10) Patent No.: US 6,620,003 B2
(45) Date of Patent: Sep. 16, 2003

(54) BOAT HAVING A COMBINATION OF JETS AND OUTBOARD MOTORS AND/OR EXTENDABLE HYDROPLANES

(75) Inventor: Albert Mardikian, Corona Del Mar, CA (US)

(73) Assignee: Golden Mardikian LLC, Corona Del Mar, CA (US)

( * ) Notice: Subject to any disclaimer, the term of this patent is extended or adjusted under 35 U.S.C. 154(b) by 0 days.

(21) Appl. No.: 09/997,560

(22) Filed: Nov. 29, 2001

(65) Prior Publication Data

US 2003/0139101 A1 Jul. 24, 2003

(51) Int. Cl.[7] ..... B63H 11/00
(52) U.S. Cl. ..... 440/38; 114/274; 114/280
(58) Field of Search ..... 114/271, 274, 114/280, 282, 284, 151; 440/38, 80

(56) References Cited

U.S. PATENT DOCUMENTS 3,593,686 A * 7/1971 Cooper et al. ..... 114/151
3,871,317 A * 3/1975 Szpytman ..... 114/282
4,938,721 A * 7/1990 Koike ..... 440/2
5,092,260 A 3/1992 Mardikian
5,193,478 A 3/1993 Mardikian
5,522,333 A * 6/1996 Lang et al. ..... 114/61.12
5,582,125 A * 12/1996 Matsumoto ..... 114/55.5
5,622,132 A 4/1997 Mardikian
6,168,481 B1 1/2001 Mardikian

* cited by examiner

*Primary Examiner*—Stephen Avila
(74) *Attorney, Agent, or Firm*—Gabor L. Szekeres

(57) ABSTRACT

A boat has one or more jet pumps with appropriate water intakes and jet nozzles to drive the boat and one or more outboard motors to drive the boat. The boat may also have one or more hydroplane fins allowing the hull of the boat to be lifted out of the water for fast hydroplaning motion. The hydroplane fins are extendable and retractable and the one or more jet pumps and/or outboard motors are movably mounted and can be lowered so as to be disposed below the water level in efficient operating position even when the hydroplane fins are extended and the hull of the boat is lifted out of the water for fast hydroplaning motion.

14 Claims, 6 Drawing Sheets

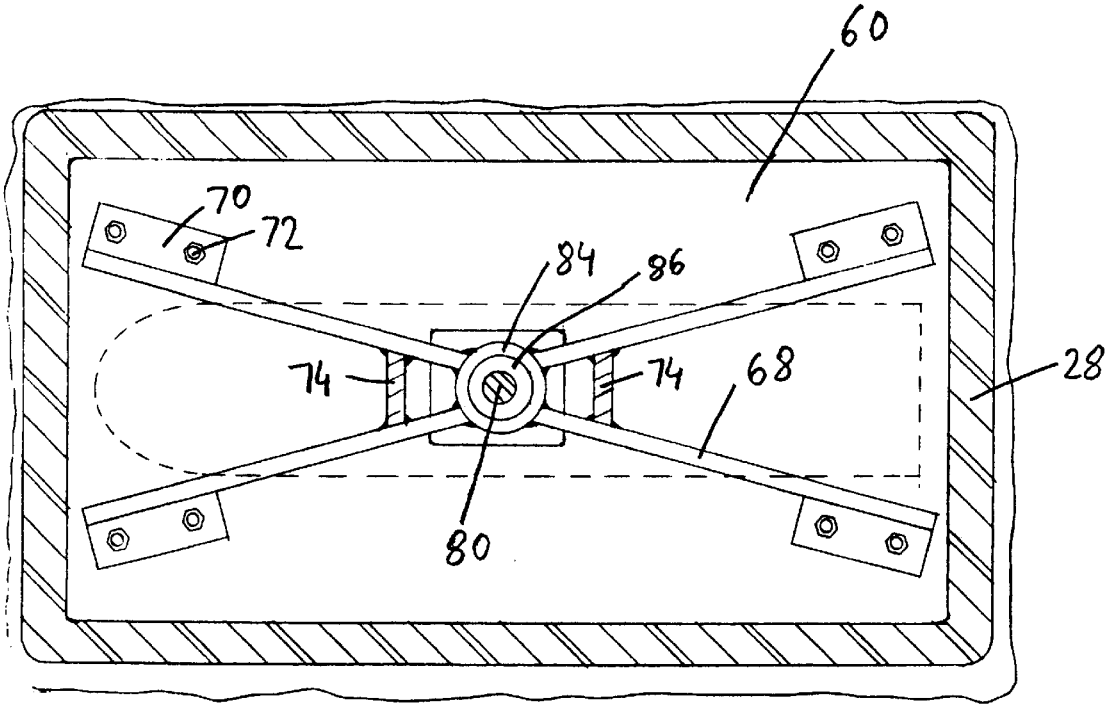
FIG. 12
FIG. 13
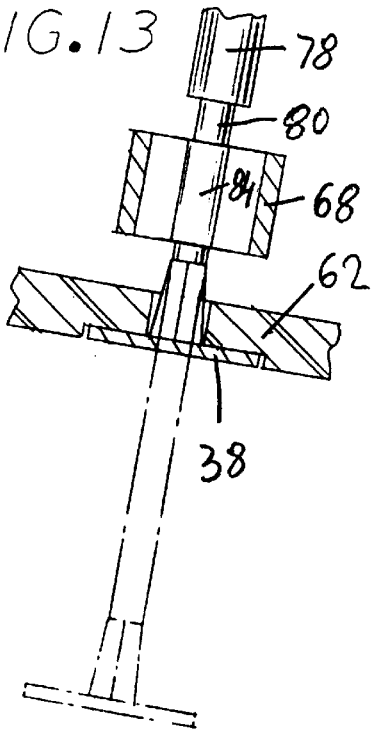
FIG. 14
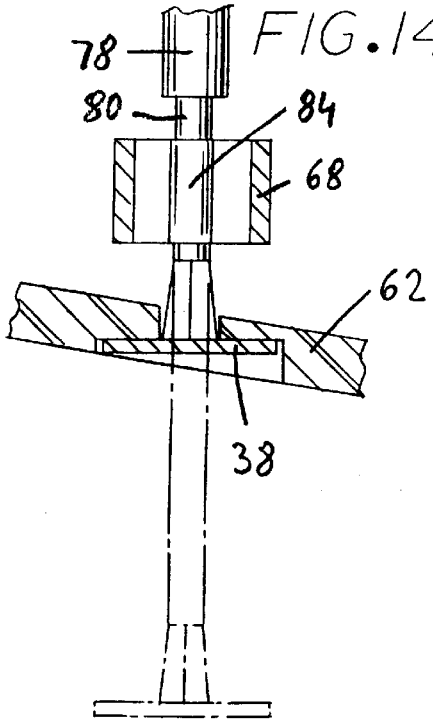

BOAT HAVING A COMBINATION OF JETS AND OUTBOARD MOTORS AND/OR EXTENDABLE HYDROPLANES

BACKGROUND OF THE INVENTION

1. Field of the Invention

The present invention is in the field of boats. More particularly, in one aspect the present invention relates to a boat that has a combination of jet motors and outboard motors for propelling the boat, with each of these motors being selectively engagable by an operator to provide optimum performance to the boat. In another aspect the present invention relates to boats that have one or more jet motors and hydroplanes and optionally outboard motors, the jet motors, hydroplanes and outboards capable of being raised or lowered into the water for providing optimum performance to the boat.

2. Brief Description of the Prior Art

Boats driven by jet pumps are old in the art. As is known, jet pumps or jet motors driving a boat draw water into an impeller through an intake which is below the water line, and eject water through one or more nozzles at the rear of the boat to drive the boat. By changing the direction of the ejected water the operator can influence the direction of movement of the boat in the water. Typically jet pump driven boats may have shallow draft and can be operated in shallow waters. A specialized jet boat with improved hull design and engine placement particularly suitable for fire fighting purposes is described in U.S. Pat. No. 6,168,481. U.S. Pat. No. 5,622,132 describe a shock-absorbing steering system for personal watercrafts which are also driven by a jet pump or jet motor. U.S. Pat. Nos. 5,092,260 and 5,193,478 describe personal watercrafts driven by a jet pump which also have specialized ride plates or flaps suitable for acting as a brake or as means to modify and increase the hydrodynamic lift to the moving watercraft.

Boats driven by outboard engines are also well known in the art. Some boats driven by outboard motors have a sufficiently powerful engine and hull shape combination that is capable of partially lifting the boat out of the water, to cause it to hydroplane. It is well known that hydroplaning boats are generally speaking capable of attaining much larger speeds than boats that slide through the water by water displacement only. There are also known boats that have hydroplane fins which when employed allow the hull of the boat to be completely lifted out of the water. A disadvantage of such a boat is that when the hull is lifted out of the water then the propeller of the driving motor is also raised, and may no longer be as efficient in engaging the water as when it is deeper below the water level.

The present invention provides a boat which combines the advantageous features of jet-pump and outboard-motor-driven boat, optionally combined with retractable and extendable hydroplane fins, and allows an operator to optimize performance of the boat under varying conditions and speeds of travel.

SUMMARY OF THE INVENTION

In accordance with one aspect of the invention a boat has one or more jet pumps with appropriate water intakes and jet nozzles to drive the boat and one or more outboard motors to drive the boat. In another aspect of the invention, a boat has one or more jet pumps and/or one or more outboard motors and/or one or more hydroplane fins allowing the hull of the boat to be lifted out of the water for fast hydroplaning motion. The hydroplane fins of such boats are extendable and retractable and the one or more jet pumps and/or outboard motors are movably mounted and can be lowered so as to be disposed below the water level in efficient operating position even when the hydroplane fins are extended and the hull of the boat is lifted out of the water for fast hydroplaning motion.

BRIEF DESCRIPTION OF THE DRAWINGS

FIG. 12 is a cross-sectional view of the equipment mounting the hydroplane fin, the cross-section being taken on lines 12,12 of FIG. 11.

FIG. 13 is a cross-section of an outboard disposed hydroplane fin of the first embodiment, the cross-section being taken on lines 13,13 of FIG. 11.

FIG. 14 is a cross-section analogous to the cross-section of FIG. 13, but taken of a further inboard disposed hydroplane fin of the second embodiment.

DETAILED DESCRIPTION OF THE INVENTION, DESCRIPTION OF THE PREFERRED EMBODIMENTS

Figure 1:
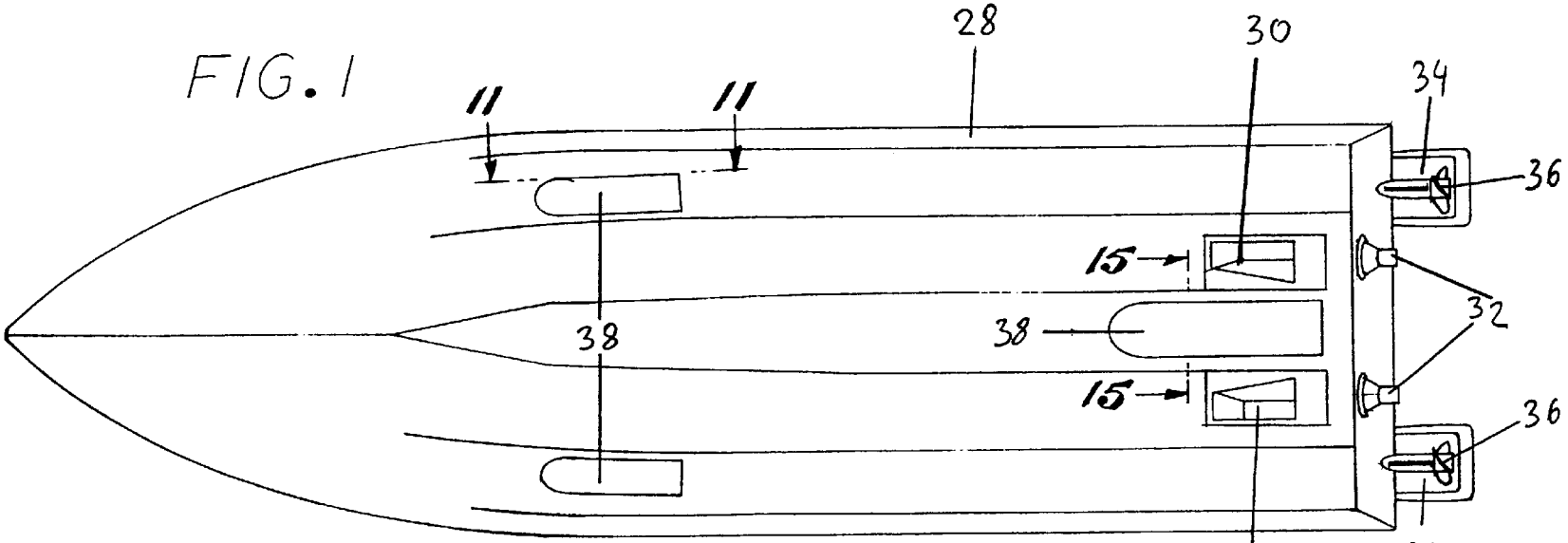
FIG. 1 is a bottom plan view of a first embodiment of a boat of the present invention, having two jet pumps, two outboard motors and three hydroplanes.

The following specification taken in conjunction with the drawings sets forth the preferred embodiments of the present invention. The embodiments of the invention disclosed herein are the best modes contemplated by the inventor for carrying out his invention in a commercial environment, although it should be understood that various modifications can be accomplished within the parameters of the present invention.

In accordance with one aspect of the present invention a boat is equipped with one or more outboard motors and with one or more jet pumps or jet engines as well, with each of these movers or drivers being positioned in such a way, that each one can be operated to best fit the conditions of the waterways in which the boat travels, and to obtain optimum performance for the desired speed of travel. In addition to equipping the boat with a combination of jet pumps and outboard motors, and still in accordance with the first aspect of the invention, the boat may also be optionally equipped with one or more hydroplane fins each of which is extendable to engage the water for fast speed travel, and retractable to substantially conform to the surface of the hull 28 when it is so desired for lower speed travel. In accordance with another general aspect of the invention the retractable and extendable hydroplane fins may be provided on boat in combination with jet pumps and or outboard motors which themselves can be lowered or raised so as to be disposed for efficient operation below the water level whether or not the hydroplane fins are extended. It should be specifically understood that the term "boat" in the present description refers to boats of all sizes which may be equipped and driven by outboard motors and/or jet pumps.

Generally speaking jet pumps or jet motors allow a boat to operate in relatively shallow water. The basic construction of a jet pump or jet motor to drive a boat is well known and is described here only in a summary fashion. Thus, as is known, jet pumps include a rotating impeller (not shown) usually driven by an internal combustion engine. Water is drawn into the impeller through an intake and the water is ejected under force by the impeller through a nozzle. Because jet pumps per se are known, only the housing 30 and water intakes of the jet pumps and the corresponding nozzles 32 are shown, where applicable, in the attached drawing figures. Beside the advantage that the boat can operate in relatively shallow water when driven by one or more jet pumps, another advantage can be obtained by placing the water intake at the bottom of the boat whereby the suction of the impeller has a stabilizing effect on boat as it is positioned in the water.

Outboard motors 34 per se are also well known in the art. Outboard motors include a propeller 36 which is driven by an internal combustion engine. It is common in the state-of-the-art to provide a mechanism for lowering an outboard motor 34 to allow its propeller 36 to effectively engage the water, and to raise the outboard motor 34 so as to make its propeller 36 operate in shallow water, or to be altogether out of the water. As is known, powerful outboard motors are capable of driving a boat at relatively high speeds across the water. However, to the present inventor's knowledge no boat has been provided in the prior art, wherein one or more outboard motors and one or more jet pumps are combined to allow an operator to select the driving force which is best suited for the conditions of waterways and the desired speed of travel. Moreover, to the best knowledge of the present inventor no boat has been provided in the prior art where in addition to a movable outboard motor and/or to a movable jet pump one or more retractable and extendable hydroplane fins 38 are also provided to enable the hull 28 of the boat to be partially lifted out of the water for high speed travel.

Figure 2:
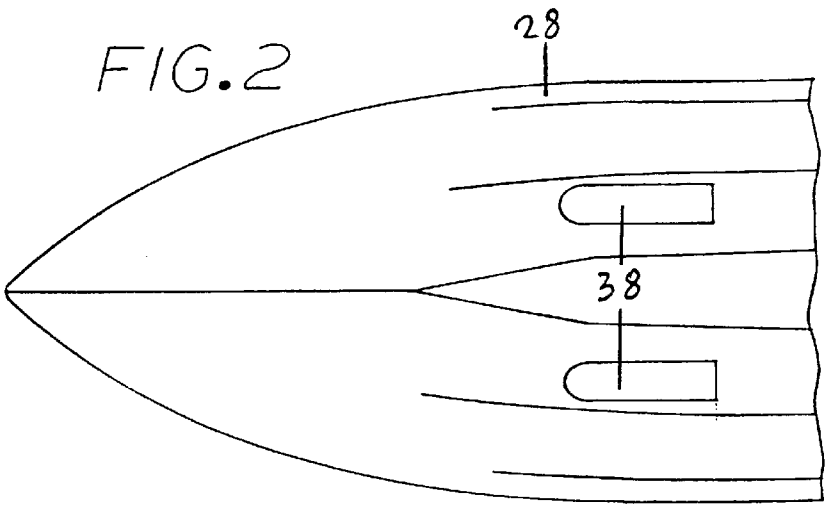
FIG. 2 is a partial bottom plan view of a second embodiment of the boat of the present invention having two hydroplanes towards the front of the boat.

FIG. 1 illustrates a first preferred embodiment of the boat of the present invention. The first preferred embodiment has two jet pumps and two outboard motors 34 mounted to the rear of the boat. The jet pumps are illustrated with the schematic showing of their respective housings 30 and their rearwardly facing nozzles 32. The first preferred embodiment is also equipped with two extendable and retractable hydroplane fins 38 located relatively close to the respective outboard edges of the boat towards the front or bow of the boat, and with a substantially centrally located similarly extendable and retractable hydroplane fin 38, towards the stem of the boat. The partial view of FIG. 2 illustrates a second preferred embodiment of the boat. The difference between the first and second preferred embodiments is only in that the frontally located two hydroplanes 38 of the second preferred embodiment are located more inboard, that is closer to the center line of the boat, than in the first preferred embodiment.

Figure 3:
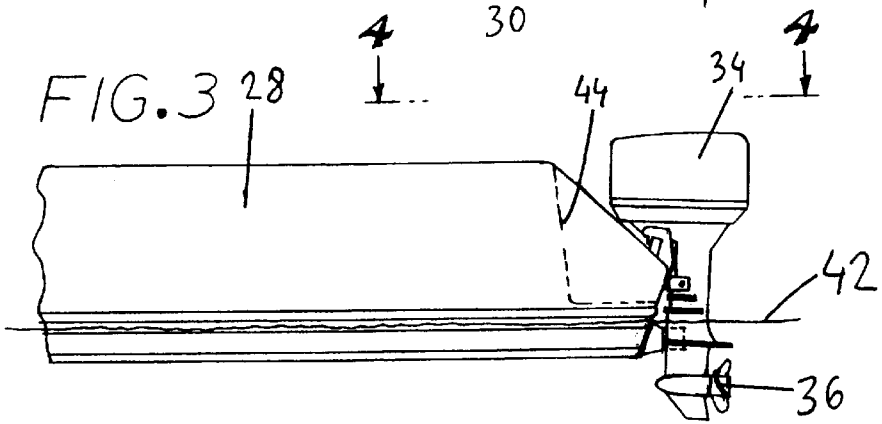
FIG. 3 is partial side view of the first embodiment.
Figure 4:
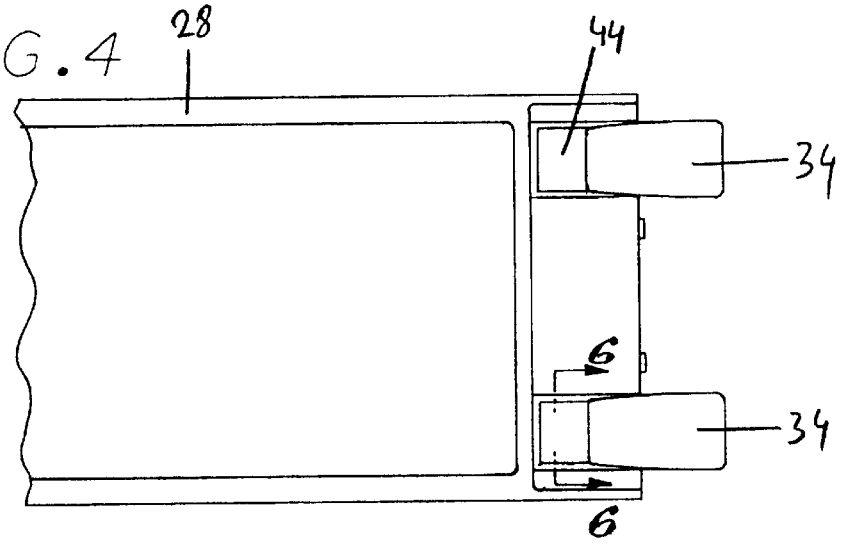
FIG. 4 is partial top plan view of an engine well utilized in the boat of the present invention.
Figure 5:
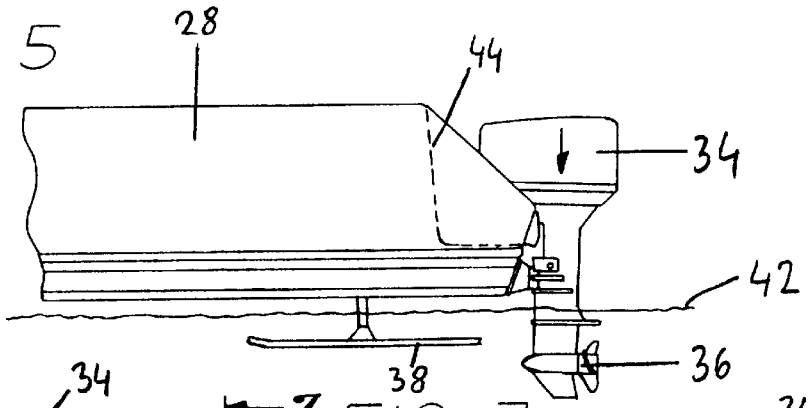
FIG. 5 is a partial side view of the first embodiment showing a rear hydroplane and an outboard motor lowered to be disposed below the water level.

FIG. 3 illustrates the mounting of outboard motor 34 to the stem of the first preferred embodiment. The water line is indicated in this drawing figure by the numeral 42. FIG. 3 illustrates the outboard motor 34 in a position wherein it is lowered with its propeller 36 being disposed below the water line 42. However as shown in FIG. 3 no hydroplane fin 38 is extended, thus in this position of the outboard 34 is disposed for relatively slow travel. FIG. 3 and FIG. 4 also show an engine well 44 into which the outboard motor 34 is mounted. The drawing of FIG. 5 illustrates the first preferred embodiment with the rear hydroplane fin 38 in an extended position, and the outboard motor 34 disposed further below the water level than in FIG. 3, so as to efficiently engage the water even when the hull 28 is lifted out of the water, and to drive the boat in a hydroplaning action across the water. Preferred examples of the mechanism or equipment for extending (lowering) and retracting the hydroplane fins 38, and for lowering and raising the outboard motors 34 are described below.

Figure 6:
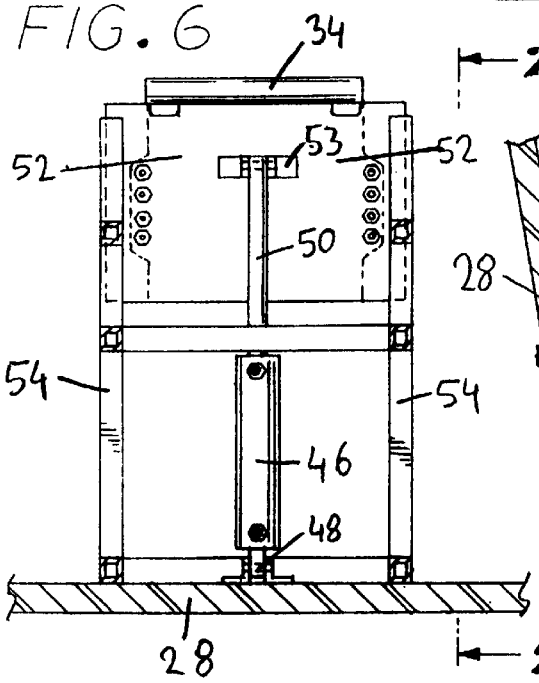
FIG. 6 is a front view of the mounting of an outboard motor in accordance with the present invention.
Figure 7:
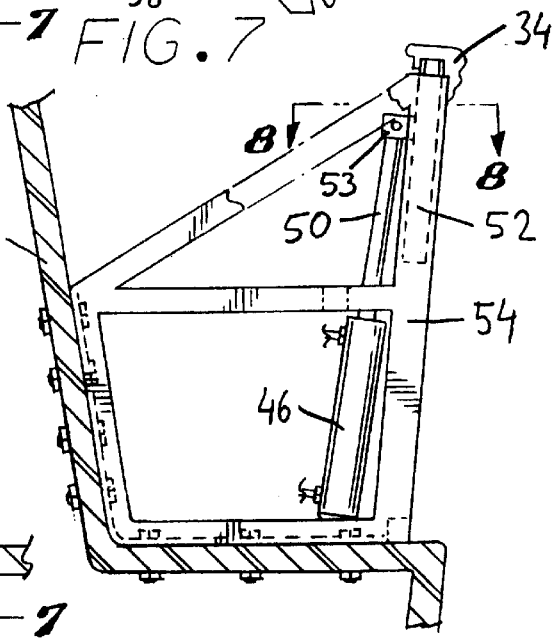
FIG. 7 is a cross-sectional view of the equipment mounting the outboard motor to the boat, the cross-section being taken on lines 7,7 of FIG. 6.
Figure 8:
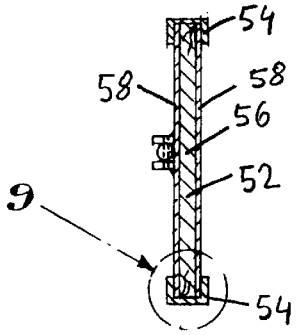
FIG. 8 is a cross-sectional view of a part of the outboard mounting equipment, the cross-section being taken on lines 8,8 of FIG. 7.
Figure 10:
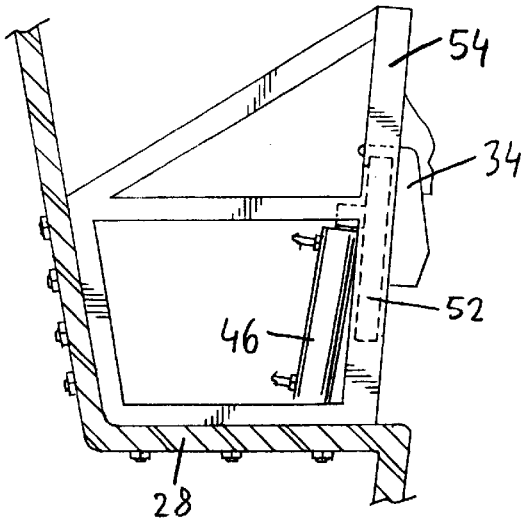
FIG. 10 is a side view of the outboard mounting equipment, showing the equipment in a position when the outboard motor has been lowered to be disposed below the water line.
Figure 9:
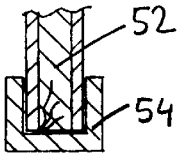
FIG. 9 is an enlarged view of the area shown in FIG. 8.

FIGS. 6 and 7 provide detailed views of the engine well 44. It should be understood that the engine well 44 is formed in the hull 28, and that a separate engine well 44 may be provided for each outboard motor 34 of the boat. The location of the engine well 44 is also shown with dotted lines in FIGS. 3 and 5. Referring now primarily to FIGS. 6 and 7, a portion of the hull 28 which forms the engine well is shown in cross-section. A hydraulic cylinder 46 is attached to the bottom of the well with a bracket 48. A piston 50, extendable and retractable from the hydraulic cylinder 46, is attached to an engine mounting plate 52 by bracket 53. The engine or outboard motor 34 is attached to the engine mounting plate 52, but the outboard motor 34 is "broken away" in the drawings and is shown only in part in FIGS. 6 and 7. The mechanism for lowering and raising the outboard motor 34 includes two U-shaped channels 54 which are also mounted to the engine well 44. The engine mounting plate 52 is capable of sliding up and down in these U-shaped channels 54 when carried by the piston 50 of the hydraulic cylinder 46. To allow this, the engine mounting plate 52 does not fit tightly in the U-shaped channels 54, as is shown in the enlarged cross-sectional view of FIG. 9. The engine mounting plate 52 of the preferred embodiment shown here is itself a composite having a wooden center 56 and metal cover plates 58. The hydraulic cylinder 46 is operated by pressure of hydraulic fluid in a manner which is itself known in the art. As it should already be apparent from the foregoing description and from the drawing figures, the engine mounting plate 52 and with it the outboard motor 34 can be moved up and down in the U-shaped channels 54 by extension or retraction of the piston 50. FIGS. 6 and 7 show the piston 50 extended from the cylinder 46 whereby the outboard motor 34 is in an elevated position but the propeller 36 is still below the water level, as is shown in FIG. 3. FIG. 10 shows the piston in a retracted position and the outboard motor 34 lowered so that the propeller 36 is below the water level even when the hull 28 is raised above the water line 42, as is shown in FIG. 5. As it will be readily understood by those skilled in the art, instead of a hydraulic cylinder other equivalent devices, such as a solenoid device (not shown) or a mechanically extendable and retractable arm (not shown) can also be used for the purpose of lowering and raising the engine mounting plate 52 and with it the outboard motor 34 in the U-shaped channels 54.

Figure 11:
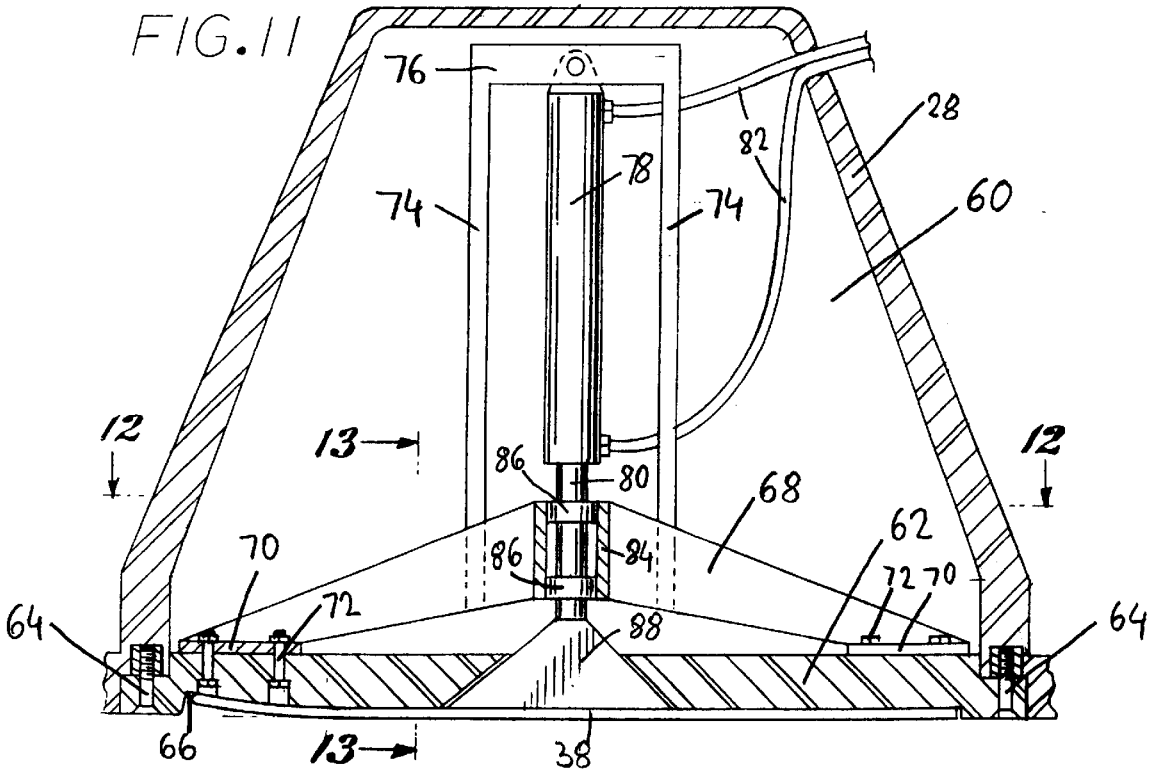
FIG. 11 is a cross-sectional view showing the placement of a hydroplane fin in the hull of a boat in accordance with the present invention.

FIGS. 11 through 15 illustrate a presently preferred example of a mechanism by which a hydroplane fin 38 is extended or retracted To accommodate this mechanism a pocket or well 60 is formed in the hull 28 itself. The bottom of this pocket 60 is sealed of with a bottom piece 62 which is attached to the hull 28 by bolts 64 or other appropriate means. A recess 66 is formed in the outer surface of the bottom piece 62 to accommodate the hydroplane fin 38 when the hydroplane fin 38 is in a retracted position. In this position, as is shown in FIG. 11 the hydroplane fin 38 is essentially flush with the bottom of the hull 28. An X-frame 68 is attached with plates 70 and bolts 72 to the bottom piece 62 within the interior of the pocket 60. The X-frame 68 includes two upright members 74 which at their upper ends are joined with a substantially horizontal cross-member 76. A hydraulic cylinder 78 including an extendable and retractable piston 80 is attached at its upper end to the cross-member 76. FIG. 11 shows lines 82 which bring pressurized hydraulic fluid to the cylinder 78. A cylindrical member 84 is incorporated in the X-frame 68 and this holds bearings 86 in which the piston 80 is centered and moves. The cylindrical member 84 is best shown in cross-section in FIG. 11. End of the piston 80 is attached to a holding member 88 that is itself attached to or is integrally constructed with the hydroplane fin 38. As is shown in FIG. 11, the holding member 88 of the preferred embodiment has the configuration of an inverted funnel. The hydroplane fin 38 is shown in FIG. 12 by dotted lines.

It can be readily understood from the foregoing description and from the drawing figures, that an operator or driver of the boat can readily extend the hydroplane fin 38 by causing the hydraulic cylinder 78 to extend the piston 80. As in connection with the mechanism described for lowering and raising the outboard motors 34, it should be understood that solenoids (not shown) or mechanically operated devices (not shown) can also be used to extend or retract the hydroplane fins 38 of the boat of the present invention.

Figure 15:
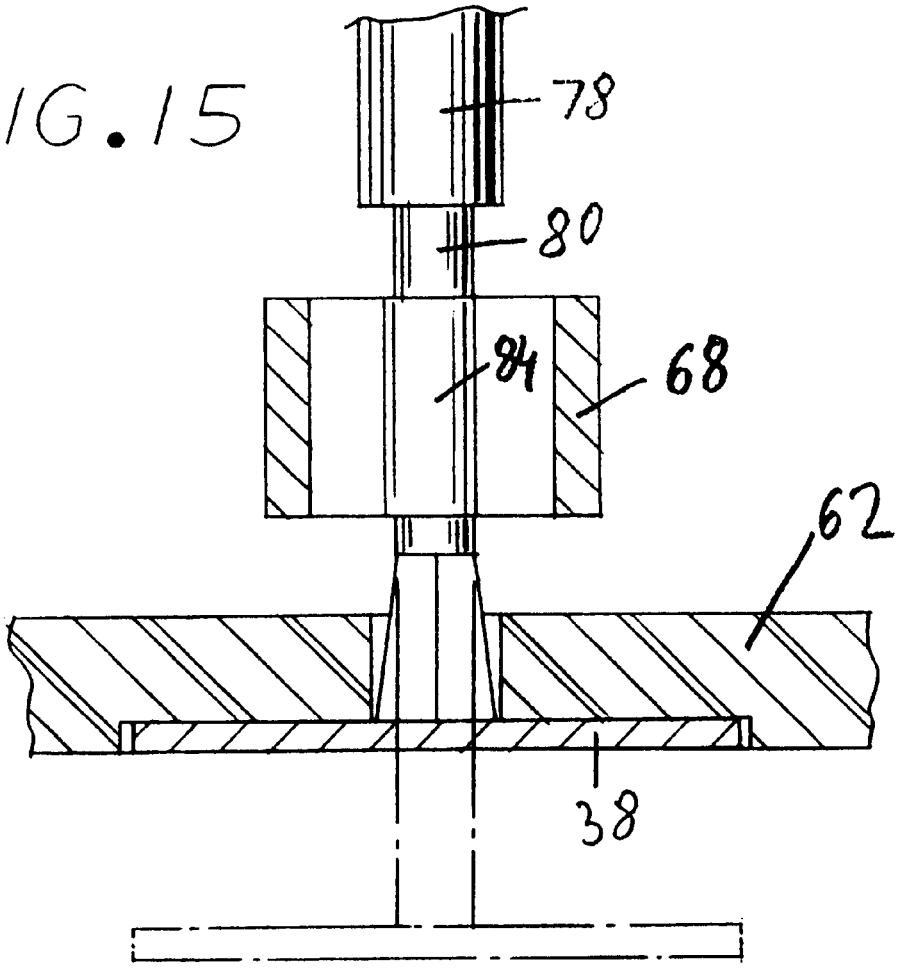
FIG. 15 is a cross-section analogous to the cross-section of FIG. 13, but taken of the rear mounted hydroplane fin of the first embodiment.

The partial and simplified view of FIG. 13 shows the hydroplane fin 38 when it is disposed in the front of the boat and relatively outboard, as in the preferred embodiment of FIG. 1. Dotted lines in this figure show the fin 38 in extended position. The partial and simplified view of FIG. 14 shows the hydroplane fin 38 in the front of the boat and further inboard, as in the preferred embodiment of FIG. 2. FIG. 15 shows the hydroplane fin 38 disposed closer to the stern of the boat and substantially along the center line, as in the preferred embodiment of FIG. 1.

Figure 16:
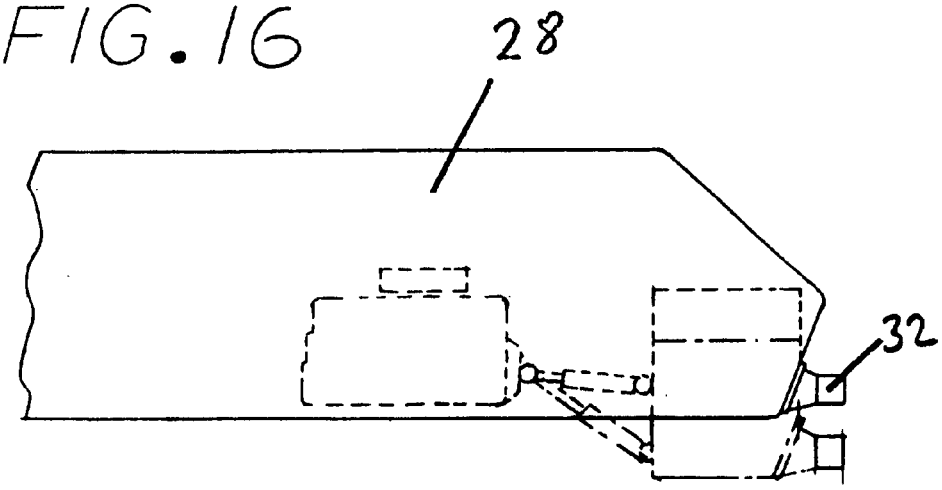
FIG. 16 is a schematic partial side view of a third preferred embodiment of the boat of the present invention wherein a jet pump including the jet nozzle can be moved between a lower and an upper position.

FIG. 16 discloses another aspect of the present invention, a boat having one or more jet pumps to drive the boat, wherein the nozzles 32 of the jet pump can be raised or lowered. Although this is not shown in this particular drawing figure, the movable jet nozzle 32 is advantageous when it is combined with one or more extendable or retractable hydroplane fin, so that when the hydroplane fins are extended and the hull 28 rises out of the water, then the nozzle 32, having been lowered is still capable of providing efficient motive power to the boat.

Figure 17:
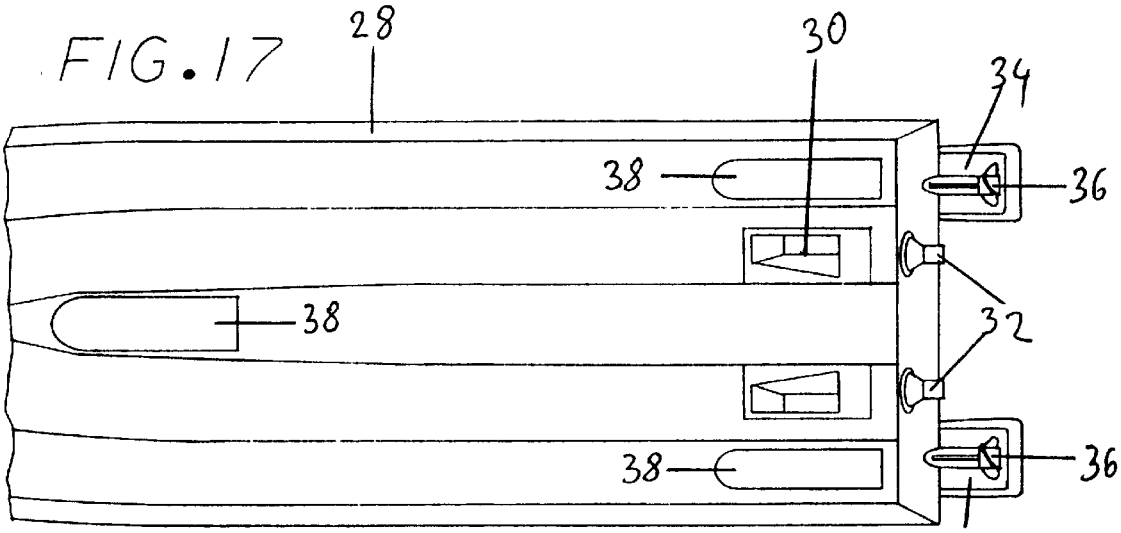
FIG. 17 is a bottom plan view of a fourth preferred embodiment having two outboard motors, two jet pumps and three hydroplane fins.
Figure 18:
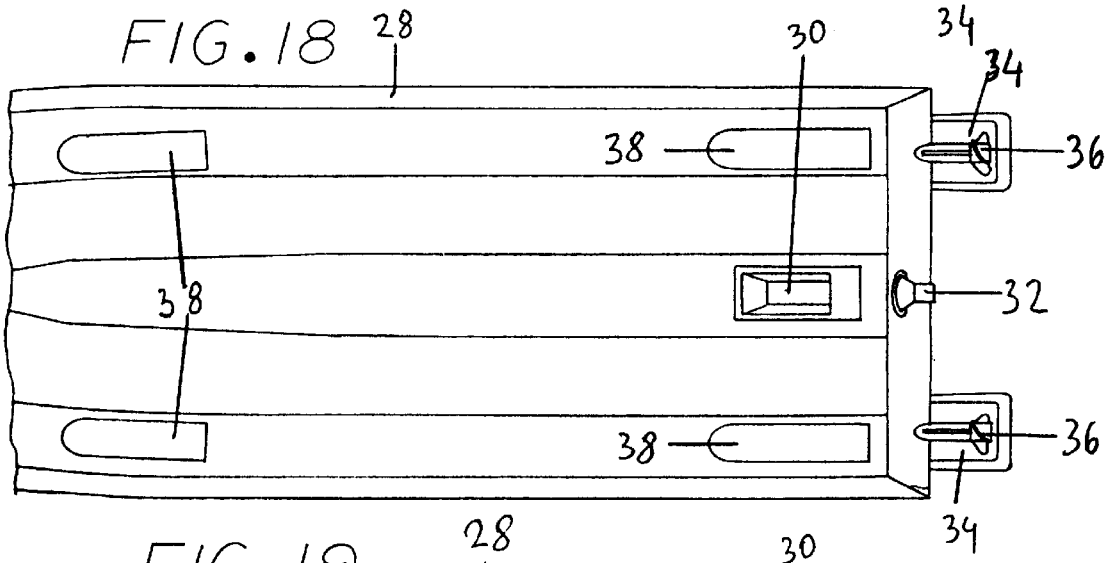
FIG. 18 is a bottom plan view of a fifth preferred embodiment having two outboard motors, one jet pump and four hydroplane fins.
Figure 19:
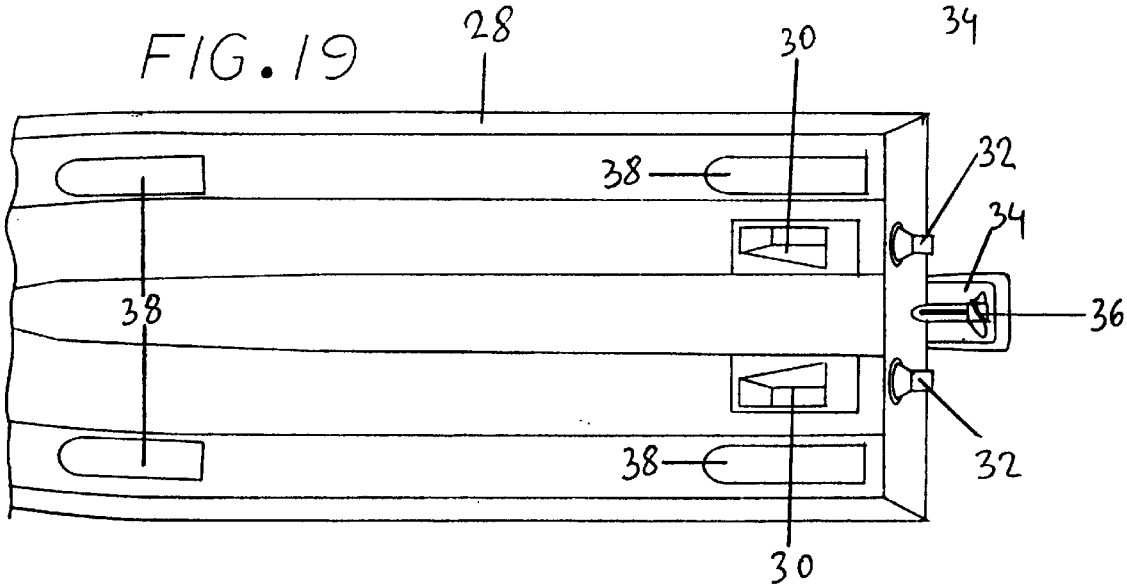
FIG. 19 is a bottom plan view of a sixth preferred embodiment having one outboard motor, two jet pumps and four hydroplane fins.

The bottom plan views of FIGS. 17, 18 and 19 disclose several embodiments of the boat of the present invention, each having different combinations of outboard motors 34, jet pumps and hydroplane fins 38, the outboard motors 34 being movable between a raised and a lowered position and the hydroplane fins 38 extendable and retractable, as described above.

It should be readily understood from the foregoing that a boat having the features of the present invention is extremely versatile and enables its operator or driver (not shown) to utilize motive power which is optimal for the waters traveled in, and also for the speed desired. In shallow waters and or for slow speed, the operator may utilize only the jet pumps to drive the boat. Alternatively slow speed travel can also be accomplished by using the outboard motors. For fast speed travel the hydroplane fins of the boat can be extended, under control of the operator or driver, and the outboard motors or nozzles of jet pumps can be lowered so that these motors efficiently engage the water even after the hull rises above the waterline. In other embodiments which lack the hydroplane fins but include a combination of jet pumps and outboard motors, the jet pumps can be used in shallow water, and the outboard motors with or without the jet pumps can used for fast travel. A further significant advantage of the invention is that operating jet pumps with water intakes at the bottom of the boat (as in the present invention) in combination with outboard motors for fast travel significantly reduces porpoising. This is because suction by the water intake of the jet pump tends to stabilize the boat on the water surface. Reduced porpoising also allows the outboard motors to be more efficient, and thereby allows the boat of the invention to attain faster speeds than otherwise possible.

Several modifications of the present invention may become readily apparent to those skilled in the art in light of the foregoing disclosure. Therefore, the scope of the present invention should be interpreted solely from the following claims, as such claims are read in light of the disclosure.

What is claimed is:

1. A boat comprising:

a hull;

an outboard motor mounted to the hull, the outboard motor having an internal combustion engine driving a propeller;

a hydroplane fin;

means operatively mounted to the hull for keeping the hydroplane fin in a first position wherein it is substantially flush with the hull and for extending the hydroplane fin in a second position below the hull to cause the hull to rise above the waterline when the boat is in rapid motion, the means also being adapted for retracting the hydroplane fin from the first position to the second position, and second means operatively mounted to the hull for keeping the outboard motor in a first position wherein the propeller is disposed below the water line when the hydroplane fin is substantially flush with the hull, and for lowering the outboard motor into a second position wherein the propeller is still disposed below the water line when the hydroplane fin is extended and the hull is raised, the second position being lower than the first position, the second means also being adapted for raising the outboard motor from the second position to the first position.

2. A boat in accordance with claim 1 wherein the means comprise a hydraulically actuated cylinder piston combination which is accommodated in a pocket formed in the bottom of the hull.

3. A boat in accordance with claim 1 wherein the second means comprise a hydraulically actuated cylinder piston combination accomodated in an engine well formed in the hull.

4. A boat in accordance with claim 1 comprising a plurality of hydroplane fins and a plurality of means, each of said means being operatively associated with one hydroplane fin.

5. A boat in accordance with claim 1 comprising a plurality of outboard motors and a plurality of second means, each of said second means being operatively associated with one outboard motor.

6. A boat comprising:

a hull;

a jet drive including an engine powering a pump connected to a water intake incorporated in the hull for drawing water to the pump, and a nozzle connected to the pump for ejecting water under force of the pump;

a hydroplane fin;

means operatively mounted to the hull for keeping the hydroplane fin in a first position wherein it is substantially flush with the hull and for extending the hydroplane fin in a second position below the hull to cause the hull to rise above the waterline when the boat is in rapid motion, the means also being adapted for retracting the hydroplane fin from the first position to the second position, and second means operatively mounted to the hull for keeping the nozzle in a first position wherein the nozzle is disposed below the water line when the hydroplane fin is substantially flush with the hull, and for lowering the nozzle into a second position wherein the nozzle is still disposed below the water line when the hydroplane fin is extended and the hull is raised, the second position being lower than the first position, the second means also being adapted for raising the nozzle from the second position to the first position.

7. A boat in accordance with claim 6 wherein the means comprise a hydraulically actuated cylinder piston combination which is accommodated in a pocket formed in the bottom of the hull.

8. A boat in accordance with claim 6 comprising a plurality of hydroplane fins and a plurality of means, each of said means being operatively associated with one hydroplane fin.

9. A boat in accordance with claim 6 comprising a plurality of jet drives each having a nozzle, and a plurality of second means, each of said second means being operatively associated with one jet drive.

10. A boat in accordance with claim 6 additionally comprising an outboard motor mounted to the hull, the outboard motor having an internal combustion engine driving a propeller.

11. A boat in accordance with claim 6 wherein the outboard motor is movable between a first position wherein the propeller is disposed below the water line when the hydroplane fin is substantially flush with the hull, and a second position wherein the propeller is still disposed below the water line when the hydroplane fin is extended and the hull is raised, the second position being lower than the first position.

12. A boat in accordance with claim 11 comprising a plurality of outboard motors, each outboard motor being movable between a first position wherein its propeller is disposed below the water line when the hydroplane fin is substantially flush with the hull, and a second position wherein its propeller is still disposed below the water line when the hydroplane fin is extended and the hull is raised, the second position being lower than the first position.

13. A boat comprising:

a hull;

a jet drive including an engine powering a pump connected to a water intake incorporated in the hull for drawing water to the pump, and a nozzle connected to the pump for ejecting water under force of the pump, and an outboard motor mounted to the hull, the outboard motor having an internal combustion engine driving a propeller, and a hydroplane fin, said hydroplane fin being mounted to the hull and being retractable to be disposed substantially flush with the hull, and being extendable below the hull to raise the hull above the waterline when the boat is in motion, wherein the outboard motor is movable between a first position wherein the propeller is disposed below the water line when the hydroplane fin is substantially flush with the hull, and a second position wherein the propeller is still disposed below the water line when the hydroplane fin is extended and the hull is raised, the second position being lower than the first position.

14. A boat comprising:

a hull;

a jet drive including an engine powering a pump connected to a water intake incorporated in the hull for drawing water to the pump, and a nozzle connected to the pump for ejecting water under force of the pump, and an outboard motor mounted to the hull, the outboard motor having an internal combustion engine driving a propeller, and a hydroplane fin, said hydroplane fin being mounted to the hull and being retractable to be disposed substantially flush with the hull, and being extendable below the hull to raise the hull above the waterline when the boat is in motion, wherein the nozzle of the jet drive is movable between a first position wherein the nozzle is disposed below the water line when the hydroplane fin is substantially flush with the hull, and a second position wherein the nozzle is still disposed below the water line when the hydroplane fin is extended and the hull is raised, the second position being lower than the first position.

* * * * *